US006212915B1

(12) United States Patent
Hohne

(10) Patent No.: US 6,212,915 B1
(45) Date of Patent: Apr. 10, 2001

(54) WARP KNITTING MACHINE WITH THREAD SHEET TURNING ARRANGEMENT

(75) Inventor: Hans-Jurgen Hohne, Hainburg (DE)

(73) Assignee: Karl Mayer Textilmaschinenfabrik GmbH, Obertshausen (DE)

( * ) Notice: Subject to any disclaimer, the term of this patent is extended or adjusted under 35 U.S.C. 154(b) by 0 days.

(21) Appl. No.: 09/639,509

(22) Filed: Aug. 16, 2000

(30) Foreign Application Priority Data

Aug. 17, 1999 (DE) ..... 199 38 872

(51) Int. Cl.[7] ..... D04B 27/12
(52) U.S. Cl. ..... 66/213; 66/209
(58) Field of Search ..... 66/125 R, 146, 66/203, 207, 209, 210, 211, 213, 214; 139/97, 98, 100, 101, 103, 104, 109, 114, 115

(56) References Cited

U.S. PATENT DOCUMENTS 2,667,772 * 2/1954 Hepp ..... 66/213
2,699,051 * 1/1955 Noe ..... 66/213
2,844,950 * 7/1958 Trumpio ..... 66/213
3,412,583 * 11/1968 Hachnel ..... 66/213
3,828,586 * 8/1974 Kohl ..... 66/146

FOREIGN PATENT DOCUMENTS 2061908 6/1972 (DE) .
231817 * 1/1986 (DE) ..... 66/213
810172 * 3/1959 (GB) ..... 66/213
1659549 * 6/1991 (SU) ..... 66/213

* cited by examiner

*Primary Examiner*—Danny Worrell
(74) *Attorney, Agent, or Firm*—Omri M. Behr

(57) ABSTRACT

A flexible sheet turning arrangement located in a thread path upstream of the guides in a warp knitting machine that has a machine frame and at least one plurality of guides. The arrangement has a set of springs with proximal ends supported on the machine frame, and free distal ends. Also included is a turning element running the full width of the machine and attached to the free distal ends of the set of springs. The set of springs may include a package having at least two leaf springs placed on top of each other and joined at their ends. At least one of the springs may be made of a material having a greater internal coefficient of friction than steel. The springs may be laid to provide such a level of damping that the damping coefficient δ satisfies a relationship involving $T_d$ the period of oscillation, and $\hat{y}_i$, $\hat{y}_{i+1}$ the neighboring amplitudes of damped oscillations.

24 Claims, 2 Drawing Sheets

WARP KNITTING MACHINE WITH THREAD SHEET TURNING ARRANGEMENT

BACKGROUND OF THE INVENTION

1. Field of the Invention

The present invention relates to a warp knitting machine having a flexible thread sheet turning arrangement upstream of the guides in which a turning element stretching across the entire working width is carried by springs, one end of which is attached to the machine frame.

2. Description of Related Art

The purpose of the springs holding the turning element is to maintain the tension of the threads in the thread sheet during stitch formation notwithstanding changes in the thread input speed. In particular, in the knockover of stitches, a sudden freeing of a thread segment occurs. This leads, in particular at higher input speeds and/or under higher operating speeds, a marking in the finished goods known as "water spots". The known springs are made of steel. They are made as leaf springs or as leg springs with many windings between the legs.

An object of the present invention is to provide a warp knitting machine of the known art, which can operate at high operating speeds and/or higher thread input speeds to produce goods without errors. This task is solved by the present invention in that the springs are formed as leaf, packages comprising at least two super-imposed leaf springs affixed at one end thereof.

SUMMARY OF THE INVENTION

In accordance with the illustrative embodiments demonstrating features and advantages of the present invention, there is provided in a warp knitting machine having a machine frame and at least one plurality of guides, a flexible sheet turning arrangement located in a thread path upstream of the guides. The arrangement includes a set of springs having proximal ends supported on the machine frame, and free distal ends. The set of springs has a package with at least two leaf springs placed on top of each other and joined at their proximal ends. Also included is a turning element running the full width of the machine and attached to the free distal ends of the set of springs.

In accordance with another aspect of the present invention, another flexible sheet turning arrangement is again provided in the thread path upstream of the guides in a warp knitting machine having a machine frame and at least one plurality of guides. The arrangement has a set of springs with proximal ends supported on the machine frame, and free distal ends. At least one of the springs is made of a material having a greater internal coefficient of friction than steel. Again, a turning element runs the full width of the machine and is attached to the free distal ends of the set of springs.

According to yet another aspect of the present invention, another flexible sheet turning arrangement is again provided in the thread path upstream of the guides in a warp knitting machine having a machine frame and at least one plurality of guides. The arrangement has a set of springs with proximal ends supported on the machine frame, and free distal ends. The springs are laid to provide such a level of damping that the damping coefficient δ is $$\delta = \frac{1}{T_d} \cdot \left( \ln \frac{\hat{y}_i}{\hat{y}_{i+1}} \right) > 2$$

wherein $T_d$ is the period and $\hat{y}_i$, $\hat{y}_{i+1}$ are the neighboring amplitudes of damped oscillations. Again, a turning element runs the full width of the machine and is attached to the free distal ends of the set of springs.

With such arrangements the springs can be made so that during the swinging step, an outer friction action occurs between the superimposed leaf springs, which has a damping effect. The damping of the mass inhibited spring system impedes excessively strong swing amplitudes. The system is thus able to follow rapid changes in the thread tension. By an appropriates selection of the damping one may ensure that the thread tension is never too small, or never reaches null point. This effect is particularly apparent when during the stitch knockover, a particular thread segment is suddenly freed.

Optimally the packet comprises three superimposed leaf springs.

In the preferred embodiment it is provided that one leaf spring in the package is connected to the turning element and is supported by at least one leaf spring of shorter length. This gives rise to extraordinarily strong damping.

Another solution for the specified task, which can be used at the same time as the previously described solution, comprises a structure wherein the springs are made of a material having a higher internal friction factor than steel. The spring material itself can therefore, be utilized for increased damping.

Desirably the springs are made of a material comprising fibers bound by synthetic material The deformations occurring during the swinging motion cause an inner friction between the fibers, that is to say, between the fibers and the synthetic material Additionally the material is lighter than steel and thus, accelerates and decelerates a smaller mass, which equally simplifies the correlation with the thread tension.

It has been found useful to extend the fibers in the axial direction (longitudinal or lengthwise) of the spring. These threads are all subject to deformation and thus, on the one hand, operate as springs and on the other hand, as dampers.

There is no limitation on the materials that may be used as fibers as long as the mechanical requirements are sufficient. Included in this group are glass fibers. Particularly desirable however, are carbon fibers which are both stable and are also grown in a rough operation.

It is further advantageous that the springs are made of a prepreg material (fibers impregnated with a material which will heat cure) which is baked in a mold. Such springs may be provided with the desired conditions by selection of the appropriated mold. By heating the prepreg materials in a baking process the synthetic material cures and so achieves the desired state. Further solutions of the posed tasks resulting therefrom that the springs are provided with such a strong damping that their damping coefficients for δ may be:

$$\delta = \frac{1}{T_d} \cdot \left( \ln \frac{\hat{y}_i}{\hat{y}_{i+1}} \right) > 2$$

wherein $T_d$ is the time of swing and $\hat{y}_i$ and $Y_{i+1}$ are neighboring amplitudes of the dampened swinging.

The best results are achieved with relatively high damping values. Thus, it is desirable that the damping coefficient should be at least 20, preferably at least 30, and optimally between 35 and 40.

As further measures, it is desirable that the resonant frequency of the springs be at least 100 Hz. Such a frequency lies substantially outside the range of operational frequencies under present consideration so that there is no danger of resonant swinging.

It is advantageous to provide the turning element as an open walled pipe through a side of which the free ends of the springs are introduced into the inner surface of the pipe. Such a pipe, in particular when it has a circular cross-section, can provide the desired stiffness with relatively small mass. Because of the small mass, the tubular turning element can react more rapidly to the tension changes in the thread sheet. One is thus able to operate at higher working speeds, or higher thread feed speeds, or both. The wall opening need only be as large as the cross-section of the springs since during operation when the thread sheet presses against the springs, comparatively small clamping and locking forces are required to obtain a secure combination. Equally, such a combination may be readily taken apart, In this connection is desirable that the free end of the spring comprises a canted and partially somewhat cylindrical support piece, which matches the internal curvature of the pipe. This gives rise to a secure, but nevertheless a loosenable combination.

It is particularly desirable that the diameter of the pipe be about 8 mm and the wall thickness be about 2 mm. Such a pipe is sufficiently stable, but also of low mass.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
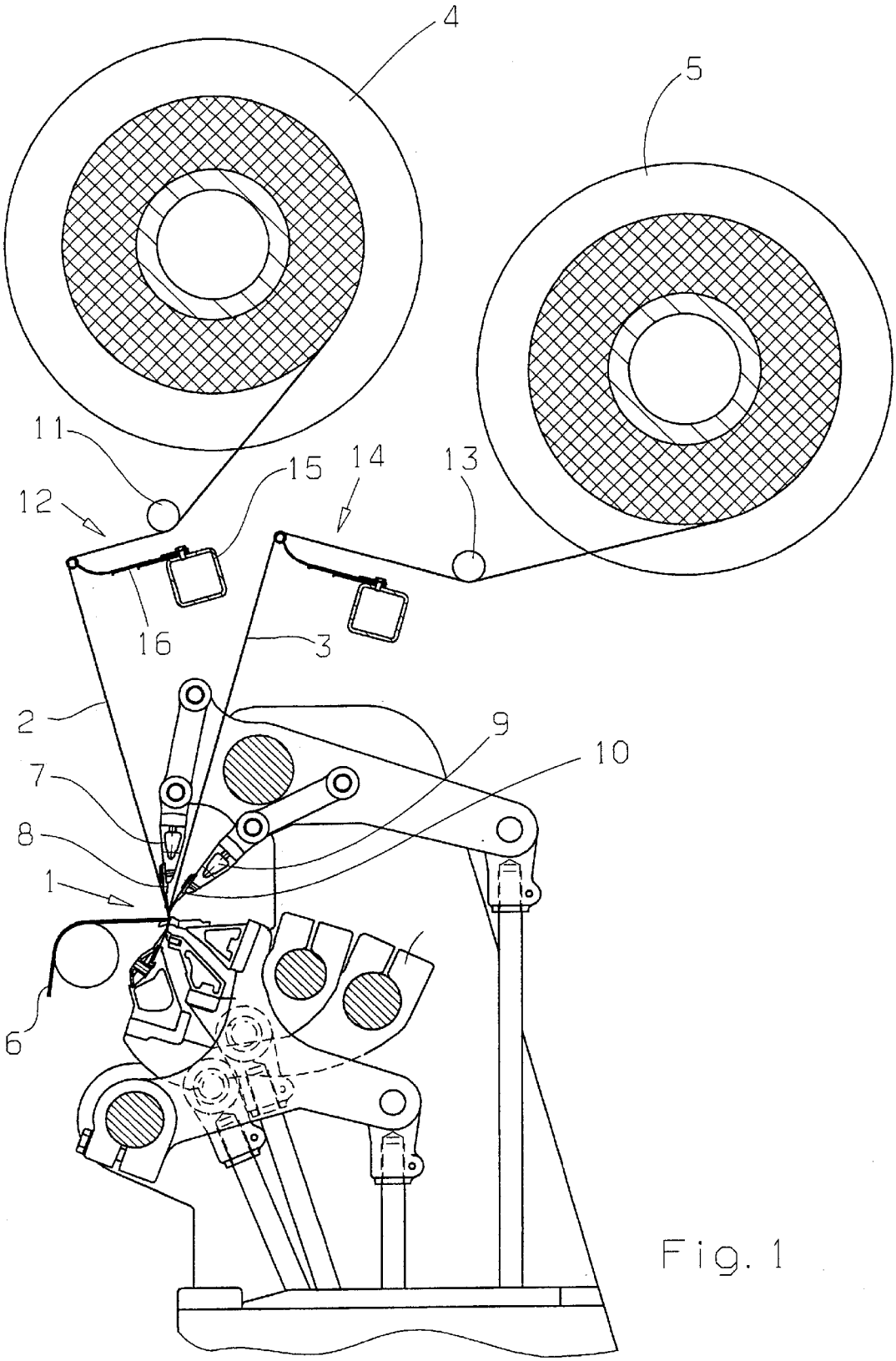
FIG. 1 is a cross-sectional, elevational side view of the working portion of a warp knitting machine.

The warp knitting machine partially illustrated in FIG. 1 comprises a working area 1 to which threads 2 and 3 are led from warp beam 4 and 5 and the finished goods are pulled off at location 6. The warp knitting machine comprises a guide bar 7 with guides 8 and a guide bar 9 with guides 10. Between the warp beam 4 and the guides 8, the threads 2 are led over a fixed turning tube 11 and a flexible turning arrangement 12. Between warp beam 5 and guides 10 the threads 3 are led over a rigid affixed turning tube 13 and a flexible turning arrangement 14.

Figure 2:
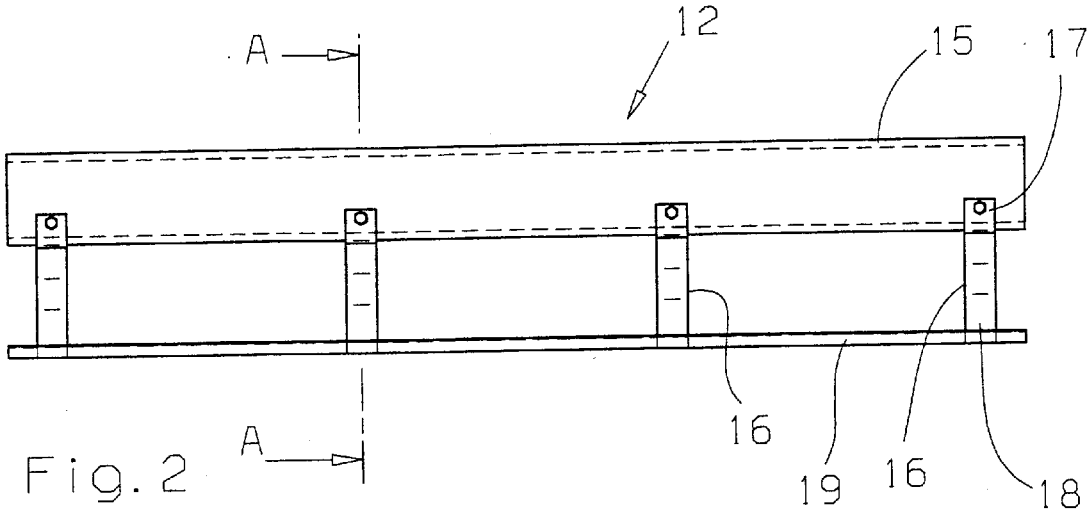
FIG. 2 is an overhead, plan view of a segment of the carrying tube of FIG. 1 together with other structure forming a thread sheet turning arrangement.

The flexible turning arrangements 12 and 14 exemplify the present invention. They both have the same structure, which is why in FIGS. 2 and 3 only the turning arrangement 12 is illustrated. A plurality of springs 16 having different lengths and oriented on top of each other, and having a commonly located, proximal end 17 are affixed to a carrying tube 15 of quadrilateral cross-section. The free ends 18 of the springs 16 carry the turning element 19, which extends for the entire width of the warp knitting machine.

Each set of springs 16 comprises three leaf springs 21, 22 and 23 placed on top of each other. Springs 16 are attached to the carrying tube 15 by screw 24. The longest leaf spring 21 extends to the turning element 19 and is subjacently supported by the shorter springs 22 and 23. The leaf spring 21 at its free distal end 18, comprises a canted support member 25 that is substantially and partially cylindrical. Support member 25 fits into the internal circumference of the pipe-shaped (tubular) turning element 19. This support member 25 is introduced into the inner area of the pip-formed turning element 19 through a slit-formed wall opening 26, which corresponds to the width of the leaf spring 21.

Upon introduction, support member 25 can be turned to be oriented in the position shown in the drawings. In this arrangement the fictional forces are sufficient to secure its position. However, additional clamping or licking forces can also be utilized.

The individual leaf springs 21, 22 and 23 are preferably made of carbon fibers connected by a synthetic material suitably, a cured polymeric material. These fibers extend lengthwise along the longitudinal axis of the springs 16. To form these springs there is utilized a prepreg material that is, an uncured synthetic material containing the fibers, which are placed in a suitable mold and cured therein suitably, by heating. In this manner there are obtained the separate leaf spring components 21–23.

By use of these fiber materials and by the layering of the package of springs there results a very substantial damping which leads to a damping coefficient $\delta$ which is greater than 2, whereby is however preferably at leas 20 and, particularly desirably, at least 30. The damping coefficient is easily determined in that the spring combination 16 (without the turning element 19) is then biased form the at rest position and then let go whereby, a swinging motion is obtained form the spring-back forces and this motion can readily be measured by a laser measuring apparatus.

Figure 3:
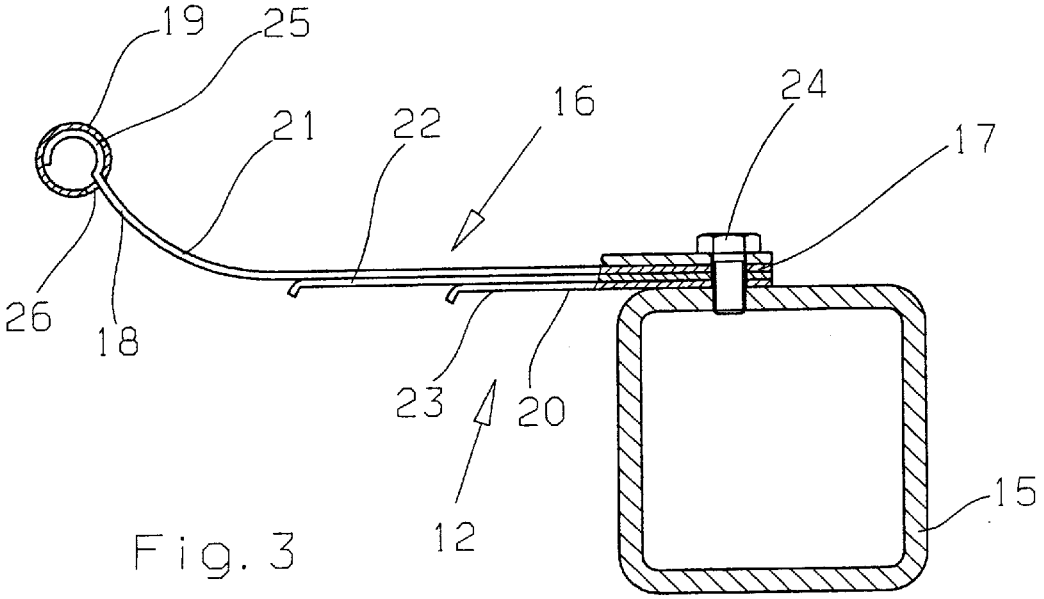
FIG. 3 is a cross-sectional, side, elevational view taken at line A—A of FIG. 2.

In a preferred embodiment in FIG. 3, the spring 21 has measurements of 116 mm by 25 mm by 0.96 mm; the spring 22 has dimensions of 81.5 mm by 25 by 0.96 mm and the spring 23, and has a dimension of 61.5 mm by 25 mm by 96 mm.

In some cases it is sufficient to merely take damping measures, The replacement of steel with a material made of fibers bound by synthetic material gives rise to a substantial increase in the damping coefficient and the layering in the package as described hereinabove is particularly influential.

Obviously, any modifications and variations of the present invention are possible in light of the above teachings. It is therefore to be understood that within the scope of the appended claims, the invention may be practiced otherwise than as specifically described.

What is claimed is:

1. In a warp knitting machine having a machine frame and at least one plurality of guides, a flexible sheet turning arrangement located in a thread path upstream of the guides, comprising:

a set of springs having proximal ends supported on the machine frame, and free distal ends, the set of springs comprising a package having at least two leaf springs placed on top of each other and joined at their proximal ends; and a turning element running the full width of the machine and attached to the free distal ends of the set of springs.

2. In a warp knitting machine in accordance with claim 1 wherein said package comprises three leaf springs located on top of each other.

3. In a warp knitting machine in accordance with claim 2 wherein one of the leaf spring sin said package is connected to the turning element and is subjacently supported by at least one another leaf spring of lesser length.

4. In a warp knitting machine in accordance with claim 1 wherein one of the leaf springs in said package is connected to the turning element and is subjacently supported by at least one other leaf spring of lesser length.

5. In a warp knitting machine in accordance with claim 1 wherein the resonant frequency of the set of springs is at least 100 Hz.

6. In a warp knitting machine in accordance with claim 5 wherein the turning element is a tubular and has at least one wall opening through which the free distal ends of the springs sets are introduced inside the turning element.

7. In a warp knitting machine in accordance with claim 6 wherein the tubular turning element has an internal curved surface, the free distal ends of the set of springs comprising a canted support member having a frustro-cylindrical outer surface corresponding to the internal curved surface of the tubular turning element.

8. In a warp knitting machine having a machine frame and at least one plurality of guides, a flexible sheet turning arrangement provided in the thread path upstream of the guides, comprising a set of springs having proximal ends supported on the machine frame, and free distal ends, at least one of the springs being made of a material having a greater internal coefficient of friction than steel; and a turning element running the full width of the machine and attached to the free distal ends of the set of springs.

9. In a warp knitting machine in accordance with claim 8 wherein, the springs are made of synthetic material having fibers embedded therein.

10. In a warp knitting machine in accordance with claim 9 wherein said fibers lie substantially lengthwise along the springs.

11. In a warp knitting machine in accordance with claim 10 wherein the fibers are carbon fibers.

12. In a warp knitting machine in accordance with claim 9 wherein the fibers are carbon fibers.

13. In a warp knitting machine in accordance with claim 11, wherein said fibers are molded and heat cured prepreg material.

14. In a warp knitting machine in accordance with claim 9, wherein said fibers are molded and heat cured prepreg material.

15. In a warp knitting machine in accordance with claim 8 wherein the resonant frequency of the set of springs is at least 100 Hz.

16. In a warp knitting machine in accordance with claim 15 wherein the turning element is a tubular and has at least one wall opening through which the free distal ends of the spring sets are introduced inside the turning element.

17. In a warp knitting machine in accordance with claim 16 wherein the tubular turning element has an internal curved surface, the free distal ends of the set of springs comprising a canted support member having a frustro-cylindrical outer surface corresponding to the internal curved surface fo the tubular turning element.

18. In a warp knitting machine having a machine frame and at least one plurality of guides, a flexible sheet turning arrangement located in the thread path upstream of the guides, comprising:

a set of springs having proximal ends supported on the machine frame, and free distal ends, the springs being laid to provide such a level of damping that the damping coefficient δ is $$\delta = \frac{1}{T_d} \cdot \left( \ln \frac{\hat{y}_i}{\hat{y}_{i+1}} \right) > 2$$

wherein, $T_d$ is the period and $\hat{y}_i$ $\hat{y}_{i+1}$ are the neighboring amplitudes of damped oscillations; and a turning element running the full width of the machine and attached to the free distal ends of the set of springs.

19. In a warp knitting machine in accordance with claim 18 wherein the damping coefficient δ is at least 20.

20. In a warp knitting machine in accordance with claim 18 wherein the damping coefficient δ is at least 30.

21. In a warp knitting machine in accordance with claim 18 wherein the resonant frequency of the set of springs is at least 100 Hz.

22. In a warp knitting machine in accordance with claim 21 wherein the turning element is a tubular and has at least one wall opening through which the free distal ends of the spring sets are introduced inside the turning element.

23. In a warp knitting machine in accordance with claim 22 wherein the tubular turning element has an internal curved surface, the free distal ends of the set of springs comprising a canted support member having a frustro-cylindrical outer surface corresponding to the internal curved surface of the tubular turning element.

24. In a warp knitting machine in accordance with claim 23 wherein the tubular turning element has an overall outside breadth of approximately 8 mm and a wall thickness of approximately 2 mm.

* * * * *